US011282425B2

(12) United States Patent
Wang et al.

(10) Patent No.: US 11,282,425 B2
(45) Date of Patent: Mar. 22, 2022

(54) SOURCE DRIVING CIRCUIT AND DISPLAY PANEL

(71) Applicant: BOE Technology Group Co., Ltd., Beijing (CN)

(72) Inventors: Donghui Wang, Beijing (CN); Hong Wang, Beijing (CN); Lijun Yuan, Beijing (CN); Yanhui Xi, Beijing (CN); Haoliang Zheng, Beijing (CN); Yuxin Bi, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/399,510

(22) Filed: Apr. 30, 2019

(65) Prior Publication Data

US 2020/0160768 A1 May 21, 2020

(30) Foreign Application Priority Data

Nov. 16, 2018 (CN) ..... 201811366411.7

(51) Int. Cl.
*G09G 3/20* (2006.01)

(52) U.S. Cl.
CPC ..... *G09G 3/20* (2013.01); *G09G 2300/0426* (2013.01); *G09G 2300/0452* (2013.01); *G09G 2300/0809* (2013.01)

(58) Field of Classification Search
CPC combination set(s) only.
See application file for complete search history.

(56) References Cited

U.S. PATENT DOCUMENTS

| | | | | |
|---|---|---|---|---|
| 2007/0188523 | A1* | 8/2007 | Lee | G09G 3/3614 345/690 |
| 2014/0198135 | A1* | 7/2014 | Eom | G09G 3/3275 345/690 |
| 2016/0078836 | A1* | 3/2016 | Kim | G09G 3/3688 345/209 |
| 2017/0221436 | A1* | 8/2017 | Guo | G09G 3/3607 |
| 2018/0261180 | A1* | 9/2018 | Zhou | G02F 1/13306 |
| 2019/0005889 | A1* | 1/2019 | Kwon | G09G 3/3233 |
| 2020/0013355 | A1* | 1/2020 | Han | G09G 3/3614 |
| 2021/0295761 | A1* | 9/2021 | Wu | G09G 3/2003 |

* cited by examiner

*Primary Examiner* — William Boddie
*Assistant Examiner* — Alecia D English
(74) *Attorney, Agent, or Firm* — McDermott Will & Emery LLP

(57) ABSTRACT

The present disclosure discloses a source driving circuit and a display panel. The source driving circuit includes a plurality of driving sub-circuits, and each of the plurality of driving sub-circuits includes: a driver, including a plurality of source channels; a plurality of switches, first terminals of the plurality of switches are electrically connected to a plurality of data lines of a display panel in one-to-one correspondence, wherein each of the plurality of source channels is electrically connected to second terminals of at least two of the plurality of switches; and a control line, electrically connected to control terminals of the plurality of switches. Sub-pixels corresponding to data lines that are electrically connected to a same source channel through the switches have the same polarity and the same color.

3 Claims, 7 Drawing Sheets

SOURCE DRIVING CIRCUIT AND DISPLAY PANEL

CROSS-REFERENCE TO RELATED APPLICATION(S)

The present application claims priority from Chinese Patent Application No. 201811366411.7 filed on Nov. 16, 2018, the disclosure of which is incorporated herein in its entirety by reference.

TECHNICAL FIELD

The present disclosure relates to the field of display technologies, and more particularly, to a source driving circuit and a display panel.

BACKGROUND

In the prior art, in order to reduce the number of source channels, a source driving circuit of a display panel typically utilizes control switches (MUX switches) to switch data paths, that is, one source channel is connected to a plurality of data lines through the control switches, and the control mode includes 1:3 mode and 1:2 mode. Typically, the display panel driven by such source driving circuit operates in a column-based inversion mode, and one source channel is electrically connected to the data lines corresponding to a plurality of sub-pixels through the control switches, such that the source channel sequentially inputs data voltages to data lines connected thereto under the control of the control switches in one row scanning period, thereby reducing the number of source channels. However, the source driving circuit of the prior art has a problem of a relatively large power consumption although the number of source channels is reduced.

SUMMARY

In an aspect of an embodiment of the present disclosure, there is proposed a source driving circuit including a plurality of driving sub-circuits, each of the plurality of driving sub-circuits includes:

a driver, including a plurality of source channels, a plurality of switches, first terminals of the plurality of switches are electrically connected to a plurality of data lines of a display panel in one-to-one correspondence, wherein each of the plurality of source channels is electrically connected to second terminals of at least two of the plurality of switches, and a control line, electrically connected to control terminals of the plurality of switches, wherein sub-pixels corresponding to data lines, that are electrically connected to a same source channel through the switches, have the same polarity and the same color.

In an embodiment, the sub-pixels corresponding to the data lines that are electrically connected to the same source channel through the switches are sequentially adjacent sub-pixels of the same polarity and the same color.

In an embodiment, the source driving circuit is configured to drive a display panel composed of pixel units each including three sub-pixels, wherein in one driving sub-circuit, a number of the switches is 18, and a number of the source channels is 6, and wherein a $i^{th}$ source channel is electrically connected to second terminals of switches corresponding to $i^{th}$, $(i+6)^{th}$, and $(i+12)^{th}$ data lines, respectively, where i is 1, . . . , or 6.

In an embodiment, the control line includes three sub-control lines, and wherein a $j^{th}$ sub-control line is electrically connected to control terminals of switches corresponding to $(6(j-1)+1)^{th}$, $(6(j-1)+2)^{th}$, . . . $(6(j-1)+6)^{th}$ data lines, where j is 1, 2, or 3.

In an embodiment, the source driving circuit is configured to drive a display panel composed of pixel units each including three sub-pixels, wherein in one driving sub-circuit, a number of the switches is 12, and a number of the source channels is 6, and wherein a $i^{th}$ source channel is electrically connected to second terminals of switches corresponding to $i^{th}$ and $(i+6)^{th}$ data lines, respectively, where i is 1, . . . , or 6.

In an embodiment, the control line includes two sub-control lines, and wherein a $j^{th}$ sub-control line is electrically connected to control terminals of switches corresponding to $(6(j-1)+1)^{th}$, $(6(j-1)+2)^{th}$, . . . , $(6(j-1)+6)^{th}$ data lines, where j is 1 or 2.

In an embodiment, the source driving circuit is configured to drive a display panel composed of pixel units each including four sub-pixels, wherein in one driving sub-circuit, a number of the switches is 12, and a number of the source channels is 4, and wherein a $i^{th}$ source channel is electrically connected to second terminals of switches corresponding to $i^{th}$, $(i+4)^{th}$, and $(i+8)^{th}$ data lines, respectively, where i is 1, 2, 3, or 4.

In an embodiment, the control line includes three sub-control lines, and wherein a $j^{th}$ sub-control line is electrically connected to control terminals of switches corresponding to $(4(j-1)+1)^{th}$, $(4(j-1)+2)^{th}$, . . . , $(4(j-1)+4)^{th}$ data lines, where j is 1, 2, or 3.

In an embodiment, the source driving circuit is configured to drive a display panel composed of pixel units each including four sub-pixels, wherein in one driving sub-circuit, a number of the switches is 8, and a number of the source channels is 4, and wherein a $i^{th}$ source channel is electrically connected to second terminals of switches corresponding to $i^{th}$ and $(i+4)^{th}$ data lines, respectively, where i is 1, 2, 3, or 4.

In an embodiment, the control line includes two sub-control lines, and wherein a $j^{th}$ sub-control line is electrically connected to control terminals of switches corresponding to $(4(j-1)+1)^{th}$, $(4(j-1)+2)^{th}$, . . . , $(4(j-1)+4)^{th}$ data lines, where j is 1 or 2.

In another aspect of an embodiment of the present disclosure, there is proposed a display panel including a source driving circuit according to the first aspect.

Other features and advantages of the present disclosure will be set forth in the following description, and will be apparent from the specification or be known to those skilled in the art by implementing the present disclosure. The objectives and other advantages of the present disclosure can be realized and obtained utilizing the structure particularly described in connection with the specification, the appended claims and the accompanying drawing.

BRIEF DESCRIPTION OF THE DRAWINGS

The accompanying drawings are used to provide a further understanding of the technical schemes of the present disclosure, constitute a part of the specification, and are used to explain the technical schemes of the present disclosure together with embodiments of the present application, without limiting the technical schemes of the present disclosure.

DETAILED DESCRIPTION

In order to make objectives, technical schemes and advantages of the present disclosure become more apparent, embodiments of the present disclosure will be described in detail below with reference to the accompanying drawings. It should be noted that, the embodiments of the present application and features therein may be arbitrarily combined with each other in a condition without inconsistency.

Figure 1:
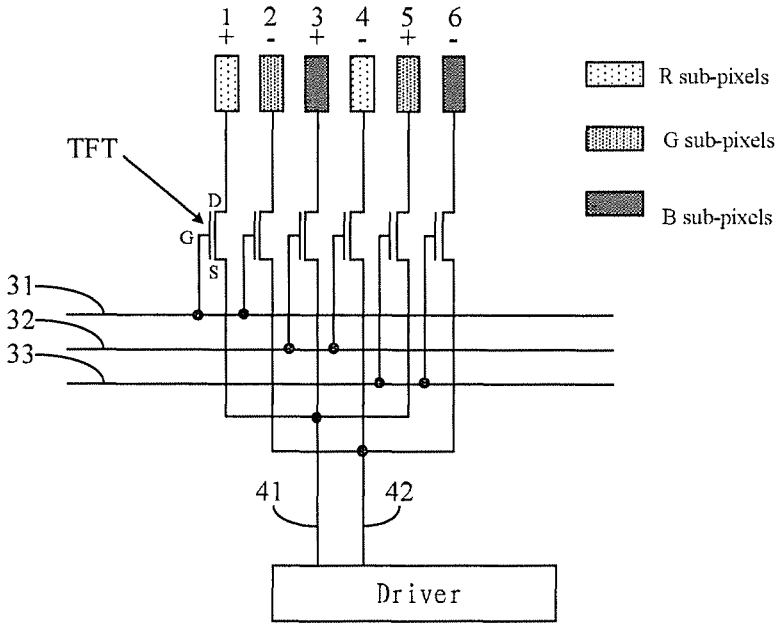
FIG. 1 is a schematic diagram of a source driving circuit.

A related source driving circuit reduces the number of source channels by using control switches to switch data paths so as to transfer data, and the control mode includes 1:3 mode and 1:2 mode. Its operating process will be explained below taking the 1:3 mode as an example. FIG. 1 is a schematic diagram of a source driving circuit. A display area of a display panel includes M*N sub-pixels arranged in an array defined by M gate lines and N data lines, and here M and N are positive integers that are greater than one. Only the first through sixth data lines, each of which corresponds to six sub-pixels among all the sub-pixels in the same row, respectively, are illustrated in FIG. 1. Here, the first through sixth data lines correspond in order to a red (R) sub-pixel, a green (G) sub-pixel, a blue (B) sub-pixel, a red (R) sub-pixel, a green (G) sub-pixel, and a blue (B) sub-pixel. In general, three red, green, and blue sub-pixels may form one pixel unit, so the first through sixth data lines illustrated in FIG. 1 correspond to two pixel units. The display panel driven by the source driving circuit illustrated in FIG. 1 operates in a column-based inversion mode, in which the polarities of sub-pixels in odd-numbered columns are positive (+), and the polarities of sub-pixels in even-numbered columns are negative (−). That is, the polarities of the red sub-pixel driven by the first data line, the blue sub-pixel driven by the third data line, and the green sub-pixel driven by the fifth data line are positive, and the polarities of the green sub-pixel driven by the second data line, the red sub-pixel driven by the fourth data line, and the blue sub-pixel driven by the sixth data line are negative.

The source driving circuit in FIG. 1 includes N thin film transistors (TFTs) being in one-to-one correspondence with respect to N data lines, and each of the N data lines is electrically connected to the drain D of the thin film transistor corresponding thereto. The driving circuit further includes three sub-control lines, which are a first sub-control line 31, a second sub-control line 32 and a third sub-control line 33, respectively. The first sub-control line 31 is electrically connected to the gates G of the first TFT and the second TFT, the second sub-control line 32 is electrically connected to the gates G of the second TFT and the fourth TFT, and the third sub-control line 33 is electrically connected to the gates G of the fifth TFT and the sixth TFT.

Figure 2:
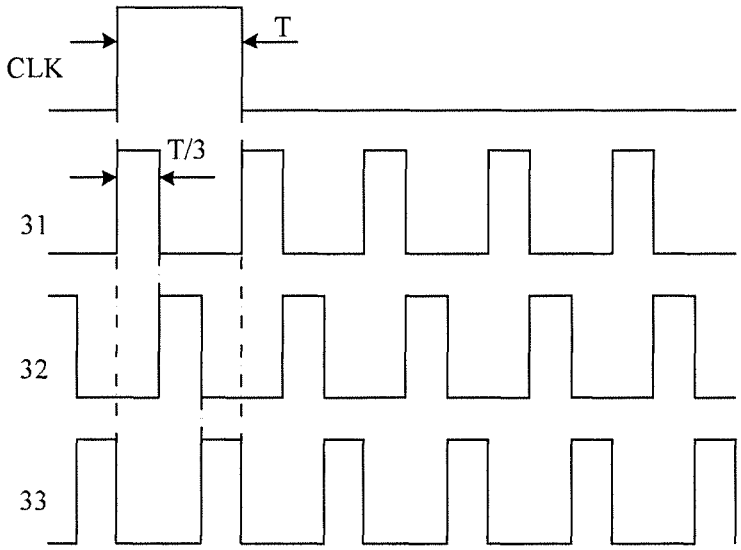
FIG. 2 illustrates on/off timing diagrams of three sub-control lines illustrated in FIG. 1.

FIG. 2 illustrates on/off timing diagrams of three sub-control lines. As illustrated in FIG. 2, one row scanning period is T, the high-level duration of each of the sub-control lines is T/3, and the three sub-control lines are sequentially turned on so as to be at high level. In FIG. 1, source channels are connected in an every second sub-pixel manner. For example, the first source channel 41 is electrically connected to the sources S of the first TFT, the third TFT, and the fifth TFT, and the second source channel 42 is electrically connected to the sources S of the second TFT and the fourth TFT and the sixth TFT. The source channels transfer data to corresponding data lines through the TFTs. Within one row scanning period T, when the first sub-control line 31 is at a high level, the first source channel 41 outputs a data voltage to the first data line 1 through the first TFT, and the second source channel 42 outputs a data voltage to the second data line 2 through the second TFT; when the second sub-control line 32 is at a high level, the first source channel 41 outputs a data voltage to the third data line 3 through the third TFT, and the second source channel 42 outputs a data voltage to the fourth data line 4 through the fourth TFT; when the third sub-control line 33 is at a high level, the first source channel 41 outputs a data voltage to the fifth data line 5 through the fifth TFT, and the second source channel 42 outputs a data voltage to the sixth data line 6 through the sixth TFT. Since the colors of the three sub-pixels corresponding to the first, third, and fifth data lines are different, although the polarities thereof are the same, the grayscales of the three sub-pixels may differ greatly from each other when a color picture is displayed. Therefore, during the process of turning on the three sub-control lines sequentially within one row scanning period, the data voltage value outputted by the first source channel 41 needs to change greatly with the switching of the sub-control lines, thereby causing the first source channel to consume a relatively large power when the data voltages are switched. Similarly, the data voltage outputted by the second source channel 42 also needs to change greatly with the switching of the sub-control lines, thereby causing the second source channel to consume a relatively large power when the data voltages are switched. As a result, the power consumption of the source driving circuit is relatively large.

In the embodiments of the present disclosure, there is proposed a source driving circuit in order to reduce the power consumption of the source driving circuit. The source driving circuit includes a plurality of driving sub-circuits, each of which includes a driver, a control line and a plurality of switches. The control line is electrically connected to control terminals of the plurality of switches, and first terminals of the plurality of switches are connected to the plurality of data lines of the display panel in one-to-one correspondence. The driver includes a plurality of source channels, each of which is electrically connected to second terminals of at least two of the switches, and the sub-pixels corresponding to the data lines that are electrically connected to the same source channel through the switches have the same polarity and the same color.

Hereinafter, the technical content of the present disclosure will be described in detail in connection with embodiments.

Generally, a display area of a display panel includes M*N sub-pixels arranged in an array defined by M gate lines and N data lines, and here both M and N are positive integers that are greater than one. The N data lines are arranged in the direction of the row, and the N data lines are disposed in one-to-one correspondence with respect to the N columns of sub-pixels. In this embodiment, the display panel adopts a column-based inversion mode, that is, the polarities of two adjacent columns of sub-pixels are opposite. For example, the polarities of odd-numbered columns of sub-pixels are positive (+), and those of even-numbered columns of sub-pixels are negative (−).

Figure 3:
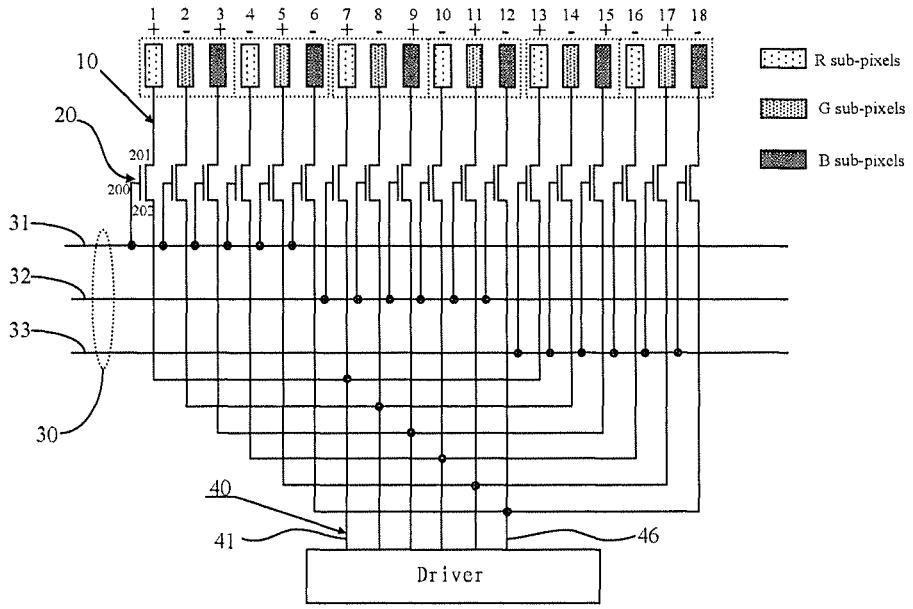
FIG. 3 is a schematic diagram of a source driving circuit according to an embodiment of the present disclosure.

FIG. 3 is a schematic diagram of a source driving circuit according to an embodiment of the present disclosure. The source driving circuit includes a plurality of driving sub-circuits, one of which is illustrated in FIG. 3. The illustrated driving sub-circuit includes control lines 30, a driver, and a plurality of switches 20, each of which includes a control terminal 200, a first terminal 201, and a second terminal 202. The switches 20 may be thin film transistors (TFTs) or other similar devices. The control lines 30 are electrically connected to the control terminals 200 of the plurality of switches 20 for controlling the on/off of the switches 20. The first terminals of the plurality of switches 20 are connected to a plurality of data lines 10 of the display panel in one-to-one correspondence, respectively. The driver has a plurality of source channels 40, each of which is electrically connected to the second terminals 202 of at least two of the switches 20, and the sub-pixels corresponding to the data lines, that are electrically connected to the same source channel through the switches 20, are sub-pixels having the same polarity and the same color. In FIG. 3, each source channel is electrically connected to the second terminals 202 of three switches 20, and three data lines are electrically connected to the same source channel through the switches 20. The three sub-pixels corresponding to the three data lines have the same polarity and color. As an example, the sub-pixels corresponding to the first data line, the seventh data line, and the thirteenth data line, that are electrically connected to the first source channel 41 through the switches 20 are R sub-pixels having positive polarities.

In the source driving circuit proposed in the embodiments of the present disclosure, since the sub-pixels corresponding to the data lines, that are electrically connected to the same source channel through the switches 20, are sub-pixels of the same polarity and the same color, so, within one row scanning period, each of the source channels may sequentially write data voltages to the corresponding sub-pixels of the same polarity and the same color as ones of the switches 20 connected thereto are turned on under the control of the control lines 30. When a screen is displayed normally, the data voltage difference corresponding to the sub-pixels having the same polarity and the same color among the same row of pixels is relatively small, thus the data voltage value outputted by each of the source channels changes little, thereby reducing the power consumption of the source channels which makes the source driving circuit has a relatively low power consumption. Therefore, the driving with low power consumption can be realized.

In order to further reduce the power consumption of the source driving circuit, in this embodiment, the sub-pixels corresponding to the data lines that are electrically connected to the same source channel through the switches 20 are sequentially adjacent sub-pixels of the same polarity and the same color. For example, in FIG. 3, the first data line, the seventh data line, and the thirteenth data line are connected to the first source channel 41 through corresponding switches, respectively, and the sub-pixels corresponding to the first data line, the seventh data line, and the thirteenth data line are three sequentially adjacent R sub-pixels having positive polarities. When an image is displayed normally by the display panel, the grayscale voltages of adjacent pixels have continuous values or a constant value, so that when the first source channel 41 sequentially inputs data voltages to the first data line, the seventh data line, and the thirteenth data line, the first source channel 41 outputs continuous voltage values or a constant voltage value, without switching between the grayscale values of the sub-pixels. Therefore, the power consumption of the source driving circuit can be further reduced.

In order to ensure that each source channel may transfer data to corresponding data lines, respectively, within one row scanning period T, the control line may include p sub-control lines (p is a natural number that is greater than or equal to 2). The turn on duration of each sub-control line is T/p, and the p sub-control lines are sequentially turned on. In this embodiment, the on/off timings of the p sub-control lines are as illustrated in FIG. 2. When the first sub-control line changes from turn on to turn off, the second sub-control line is turned on; when the second sub-control line is turned off, the third sub-control line is turned on, and so on. Within one row scanning period T, the total turn on duration of the p sub-control lines is one row scanning period T. In a driving sub-circuit, each source channel is electrically connected to second terminals of the p switches. During the row scanning period, source channels transfer data to the corresponding data lines sequentially as the p sub-control lines are sequentially turned on.

It will be readily understood that a pixel unit of a display panel typically includes a plurality of sub-pixels. When the number of the sub-pixels of the pixel unit is m (m is an odd number other than 1), one driving sub-circuit may include 2*k*m switches (k is a natural number greater than or equal to 2), and correspondingly, one driving sub-circuit drives 2*k*m data lines. In this embodiment, one driving sub-circuit drives data lines corresponding to 2 k adjacent pixel units. In order to enable each of the source channels to transfer data to a unique data line when a sub-control line is turned on, the number p of sub-control lines satisfies p=k. Accordingly, in one driving sub-circuit, each of the source channels is electrically connected to the second terminals of k switches, and the number of source channels is 2 m. Then, in one driver sub-circuit:

the $i^{th}$ source channel is electrically connected to the second terminals of the switches corresponding to the $i^{th}$, $(i+2\ m)^{th}$, . . . , $(i+2(p-1)m)^{th}$ data lines, where i may be 1, . . . , or 2 m;

the $j^{th}$ sub-control line is electrically connected to the control terminals of the switches corresponding to the $(2\ m(j-1)+1)^{th}$, 1, $(2\ m(j-1)+2)^{th}$, . . . , $(2\ m(j-1)+2\ m)^{th}$ data lines, where j may be 1, . . . , or p.

In order to facilitate further description of the driving circuit, in this embodiment, the pixel unit of the display panel includes three sub-pixels, that is, one pixel unit includes three sub-pixels that are red (R) sub-pixel, green (G) sub-pixel, and blue (B) sub-pixel. The number of sub-control lines is p=3, as illustrated in FIG. 3, and the on/off timings of the three sub-control lines are illustrated in FIG. 2. One driving sub-circuit correspondingly drives the data lines corresponding to six sequentially adjacent pixel units. The number of source channels in the driving sub-circuit is six, and each of the source channels is electrically connected to the second terminals of the three switches.

In the driving sub-circuit illustrated in FIG. 3, the $i^{th}$ source channel is electrically connected to the second terminals of the switches corresponding to the $i^{th}$, $(i+6)^{th}$, and $(i+12)^{th}$ data lines, where i may be 1, . . . , or 6. The sub-pixels corresponding to the $i^{th}$, $(i+6)^{th}$, and $(i+12)^{th}$ data lines have the same polarity and the same color.

In the driving sub-circuit, the $j^{th}$ sub-control line is electrically connected to the control terminals of the switches corresponding to the $(6(j-1)+1)^{th}$, $(6(j-1)+2)^{th}$, . . . , $(6(j-1)+6)^{th}$ data lines, where j may be 1, 2, or 3.

In the driving sub-circuit illustrated in FIG. 3, the number of source channels is 6, and the source channels are the first, second, third, fourth, fifth, and sixth source channels from left to right in sequence as illustrated in FIG. 3. The first source channel 41 is electrically connected to the second terminals 202 of the switches corresponding to the $1^{st}$, $7^{th}$, and $13^{th}$ data lines; the second source channel 42 is electrically connected to the second terminals 202 of the switches corresponding to the $2^{nd}$, $8^{th}$, and $14^{th}$ data lines; the third source channel 43 is electrically connected to the second terminals 202 of the switches corresponding to the $3^{rd}$, $9^{th}$, and $15^{th}$ data lines; the fourth source channel 44 is electrically connected to the second terminals 202 of the switches corresponding to the $4^{th}$, $10^{th}$, and $16^{th}$ data lines; the fifth source channel 45 is electrically connected to the second terminals 202 of the switches corresponding to the $5^{th}$, $11^{th}$, and $17^{th}$ data lines; the sixth source channel 46 is electrically connected to the second terminals 202 of the switches corresponding to the $6^{th}$, $12^{th}$ and $18^{th}$ data lines. The sub-pixels corresponding to the data lines connected to the same source channel are sub-pixels having the same polarity and the same color.

In the driving sub-circuit illustrated in FIG. 3, the number of sub-control lines is three. Among the three sub-control lines, the first sub-control line 31 is electrically connected to the control terminals 200 of the switches corresponding to the $1^{st}$, . . . , $6^{th}$ data lines; the second sub-control line 32 is electrically connected to the control terminals 200 of the switches corresponding to the $7^{th}$, . . . , $12^{th}$ data lines; the third sub-control line 33 is electrically connected to the control terminals 200 of the switches corresponding to the $13^{th}$, $18^{th}$ data lines.

Figure 4:
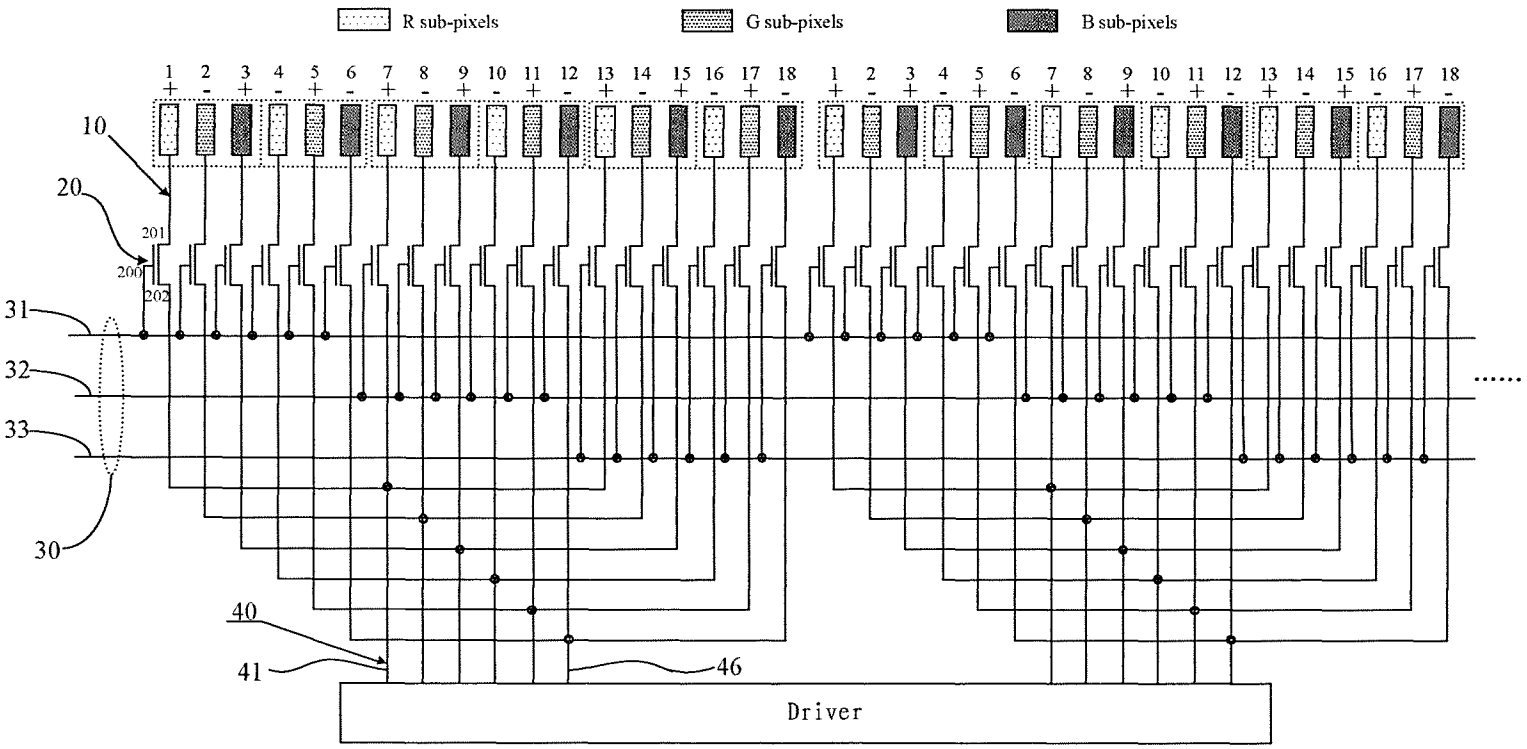
FIG. 4 illustrates a schematic diagram of a source driving circuit including more than two driving sub-circuits according to an embodiment of the present disclosure.

FIG. 4 illustrates a schematic diagram of a source driving circuit including more than two driving sub-circuits. In FIG. 4, a plurality of driving sub-circuits share sub-control lines, and the $j^{th}$ sub-control line is electrically connected to the control terminals of the switches corresponding to the $(6(j-1)+1)^{th}$, $(6(j-1)+2)^{th}$, . . . , $(6(j-1)+6)^{th}$ data lines in each of the plurality of driving sub-circuits. In each driving sub-circuit, the $i^{th}$ source channel is electrically connected to the second terminals of the switches corresponding to the $i^{th}$, $(i+6)^{th}$, $(i+12)^{th}$ data lines, respectively.

The working principle of the source driving circuit of the embodiments of the present disclosure will be described in detail below with reference to FIGS. 2 and 4.

Within one row scanning period T, when the first sub-control line 31 is turned on, the switches 20 corresponding to the $1^{st}$ to $6^{th}$ data lines in each driving sub-circuit are turned on, the first source channel, the second source channel, the third source channel, the fourth source channel, the fifth source channel and the sixth source channel input data voltages to the corresponding $1^{st}$ to $6^{th}$ data lines, respectively, thus data is written to the $1^{st}$ to $6^{th}$ sub-pixels;

when the first sub-control line 31 changes from the high level to a low level and the second sub-control line 32 is turned on, the switches 20 corresponding to the $7^{th}$ to $12^{th}$ data lines in each driving sub-circuit are turned on, the first source channel, the second source channel, the third source channel, the fourth source channel, the fifth source channel, and the sixth source channel input data voltages to the $7^{th}$ to $12^{th}$ data lines, respectively, thus data is written to the $7^{th}$ to $12^{th}$ sub-pixels;

when the second sub-control line 32 changes from the high level to a low level and the third sub-control line 33 is turned on, the switches 20 corresponding to the $13^{th}$ to $18^{th}$ data lines in each driving sub-circuit are turned on, the first source channel, the second source channel, the third source channel, the fourth source channel, the fifth source channel, and the sixth source channel input data voltages to the $13^{th}$ to $18^{th}$ data lines, respectively, thus data is written to the $13^{th}$ to $18^{th}$ sub-pixels.

As such, corresponding data is written to the entire row of sub-pixels at the end of the row scanning period T.

When the first sub-control line 31, the second sub-control line 32, and the third sub-control line 33 are sequentially switched, the first source channel sequentially inputs data to the first data line, the seventh data line, and the thirteenth data line. The sub-pixels corresponding to the first data line, the seventh data line, and the thirteenth data line are all R sub-pixels having positive polarities. When an image is displayed normally by the display panel, the grayscale voltages of adjacent pixels have continuous values or a constant value, so that during the sequential switching process of the first sub-control line 31, the second sub-control line 32, and the third sub-control line 33, the data voltages output by the first source channel have continuous values or a constant value, which greatly reduces the power consumption of the driving circuit. Similarly, during the sequential switching process of the first sub-control line 31, the second sub-control line 32, and the third sub-control line 33, the data voltages output by the second source channel, the third source channel, the fourth source channel, the fifth source channel, and the sixth source channels also have continuous values or a constant value, which enables to realize the driving with low power consumption.

It will be readily understood that the display panel generally includes a plurality of pixel units in the row direction, and the total number of the pixel units may not be an integer multiple of 6. As an example, there are 1024 pixel units in the row direction. In this case, 1020 pixel units among them may be driven by 170 complete driving sub-circuits, and the remaining 4 pixel units may be driven by an incomplete driving sub-circuit as required.

Figure 5:
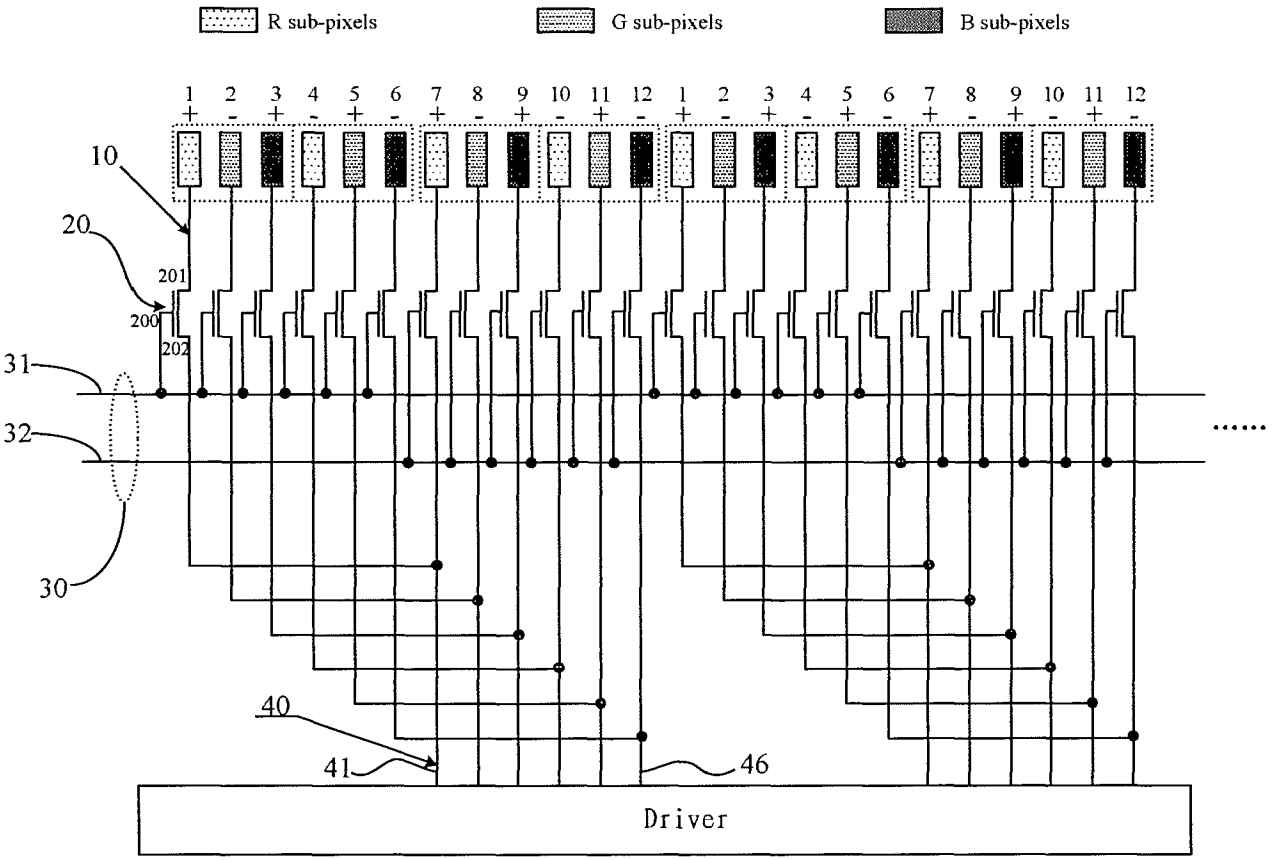
FIG. 5 is a schematic diagram of a source driving circuit according to an embodiment of the present disclosure.

FIG. 5 is a schematic diagram of a source driving circuit according to an embodiment of the present disclosure. Different from the first embodiment, in this embodiment, one driving sub-circuit includes two sub-control lines, the turn on duration of each of which is T/2, one driving sub-circuit correspondingly drives data lines corresponding to four sequentially adjacent pixel units, and the number of source channels in the driving sub-circuit is 6, each of which is electrically connected to the second terminals of the two switches.

In the driving sub-circuit, the $i^{th}$ source channel is electrically connected to the second terminals of the switches corresponding to the $i^{th}$, $(i+6)^{th}$ data lines, respectively, where i may be 1, . . . , or 6. The sub-pixels corresponding to the $i^{th}$, $(i+6)^{th}$, and $(i+12)^{th}$ data lines have the same polarity and the same color.

In the driving sub-circuit, the $j^{th}$ sub-control line is electrically connected to the control terminals of the switches corresponding to the $(6(j-1)+1)^{th}$, $(6(j-1)+2)^{th}$, . . . , $(6(j-1)+6)^{th}$ data lines, where j may be 1, or 2.

The working principle of the source driving circuit of the embodiment of the present disclosure is described below.

Within one row scanning period T, when the first sub-control line 31 is turned on, the switches 20 corresponding to the $1^{st}$ to $6^{th}$ data lines in each driving sub-circuit are turned on, the first source channel, the second source channel, the third source channel, the fourth source channel, the fifth source channel and the sixth source channel input data voltages to the corresponding $1^{st}$ to $6^{th}$ data lines, respectively, thus data is written to the $1^{st}$ to $6^{th}$ sub-pixels;

when the first sub-control line 31 changes from the high level to a low level and the second sub-control line 32 is turned on, the switches 20 corresponding to the $7^{th}$ to $12^{th}$ data lines in each driving sub-circuit are turned on, the first source channel, the second source channel, the third source channel, the fourth source channel, the fifth source channel, and the sixth source channel input data voltages to the $7^{th}$ to $12^{th}$ data lines, respectively, thus data is written to the $7^{th}$ to $12^{th}$ sub-pixels.

As such, corresponding data is written to the entire row of sub-pixels at the end of the row scanning period T.

Figure 6:
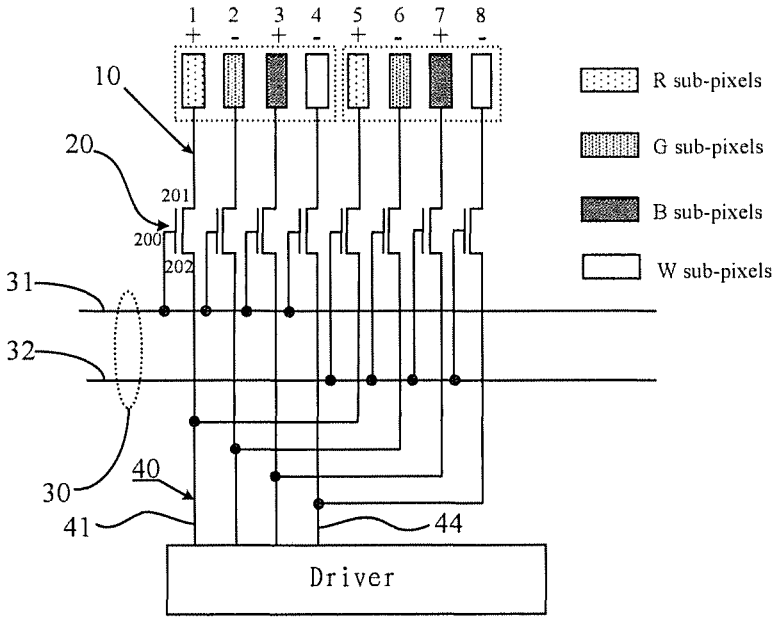
FIG. 6 is a schematic structure diagram of a source driving circuit according to an embodiment of the present disclosure.

FIG. 6 is a schematic structure diagram of a source driving circuit according to an embodiment of the present disclosure. Only one driving sub-circuit is illustrated in FIG. 6. Different from the first embodiment, in this embodiment, a pixel unit of a display panel driven by the source driving circuit includes m sub-pixels (m is an even number). Then, one driving sub-circuit may include k*m switches (k is a natural number greater than or equal to 2), and accordingly, one driving sub-circuit correspondingly drives k*m data lines. In this embodiment, one driving sub-circuit correspondingly drives data lines corresponding to k sequentially adjacent pixel units. The number of sub-control lines is p=k, and the number of source channels is m.

The $i^{th}$ source channel is electrically connected to the second terminals of the switches corresponding to the $i^{th}$, $(i+m)^{th}$, $(i+2\ m)^{th}$, . . . , $(i+(p-1)m)^{th}$ data lines, respectively, where i may be 1, . . . , or m;

The $j^{th}$ sub-control line is electrically connected to the control terminals of the switches corresponding to the $(m(j-1)+1)^{th}$, $(m(j-1)+2)^{th}$, . . . , $(m(j-1)+m)^{th}$ data lines, respectively, where j may be 1, . . . , or p.

In order to facilitate further description of the driving circuit, in this embodiment, the pixel unit of the display panel includes four sub-pixels, that is, one pixel unit includes a red (R) sub-pixel, a green (G) sub-pixel, a blue (B) sub-pixel, and a white (W) sub-pixel.

Figure 7:
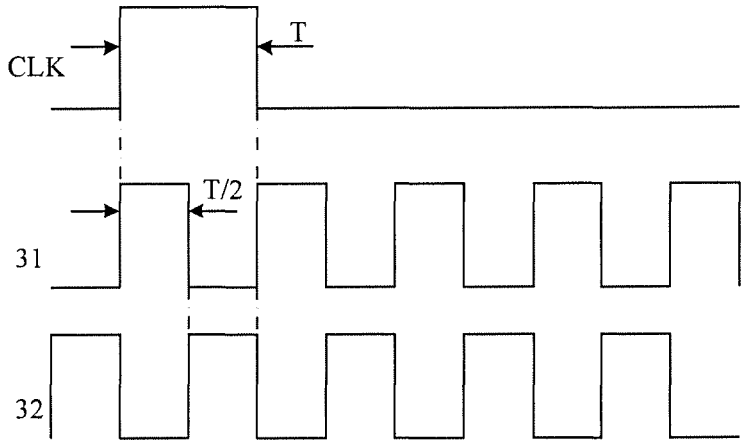
FIG. 7 illustrates on/off timing diagrams of sub-control lines illustrated in FIG. 6 according to an embodiment of the present disclosure.

FIG. 7 illustrates on/off timing diagrams of sub-control lines illustrated in FIG. 6 according to an embodiment of the present disclosure. In this embodiment, the number p of sub-control lines is 2, a row scanning period is T, and the turn on duration of each of the sub-control lines (for example, the time period during which it is at a high level) is T/2. One driving sub-circuit correspondingly drives data lines corresponding to two sequentially adjacent pixel units. The driving sub-circuit includes four source channels, each of which is electrically connected to the second terminals of the two switches, as shown in FIG. 6.

In each driving sub-circuit, $j^{th}$ sub-control line is electrically connected to the control terminals of the switches corresponding to the data lines for the $(4(j-1)+1)^{th}$, . . . , $(4(j-1)+4)^{th}$ column of sub-pixels in each driving sub-circuit. In each driving sub-circuit, the $i^{th}$ source channel is electrically connected to the second terminals of the switches corresponding to the data lines for the $i^{th}$, $(i+4)^{th}$ column of sub-pixels, where j may be 1, or 2, and i may be 1, 2, 3, or 4.

In the driving sub-circuit illustrated in FIG. 6, the number of source channels is 4. Among the four source channels, the first source channel 41 is electrically connected to the second terminals 202 of the switches corresponding to the $1^{st}$ and $5^{th}$ data lines; the second source channel 42 is electrically connected to the second terminals 202 of the switches corresponding to the $2^{nd}$ and $6^{th}$ data lines; the third source channel 43 is electrically connected to the second terminals 202 of the switches corresponding to the $3^{rd}$ and $7^{th}$ data lines; the fourth source channel 44 is electrically connected to the second terminals 202 of the switches corresponding to the $4^{th}$ and $8^{th}$ data lines. The number of sub-control lines is 2. Among the two sub-control lines, the first sub-control line 31 is electrically connected to the control terminals 200 of the switches corresponding to the $1^{st}$, . . . , $4^{th}$ data lines; and the second sub-control line 32 is electrically connected to the control terminals 200 of the switches corresponding to the $6^{th}$, . . . , $8^{th}$ data lines.

The working principle of the driving circuit of the embodiment of the present disclosure will be described in detail below with reference to FIGS. 6 and 7.

Within one row scanning period T, when the first sub-control line 31 is turned on, the switches 20 corresponding to the $1^{st}$ to $4^{th}$ data lines in each driving sub-circuit are turned on, the first source channel, the second source channel, the third source channel, and the fourth source channel input data voltages to the corresponding $1^{st}$ to $4^{th}$ data lines, respectively, thus data is written to the $1^{st}$ to $4^{th}$ sub-pixels;

when the first sub-control line 31 changes from the high level to a low level and the second sub-control line 32 is turned on, the switches 20 corresponding to the $5^{th}$ to $8^{th}$ data lines in each driving sub-circuit are turned on, the first source channel, the second source channel, the third source channel, and the fourth source channel input data voltages to the $5^{th}$ to $8^{th}$ data lines, respectively, thus data is written to the $5^{th}$ to $8^{th}$ sub-pixels.

As such, corresponding data is written to the entire row of sub-pixels at the end of the row scanning period T.

Figure 8:
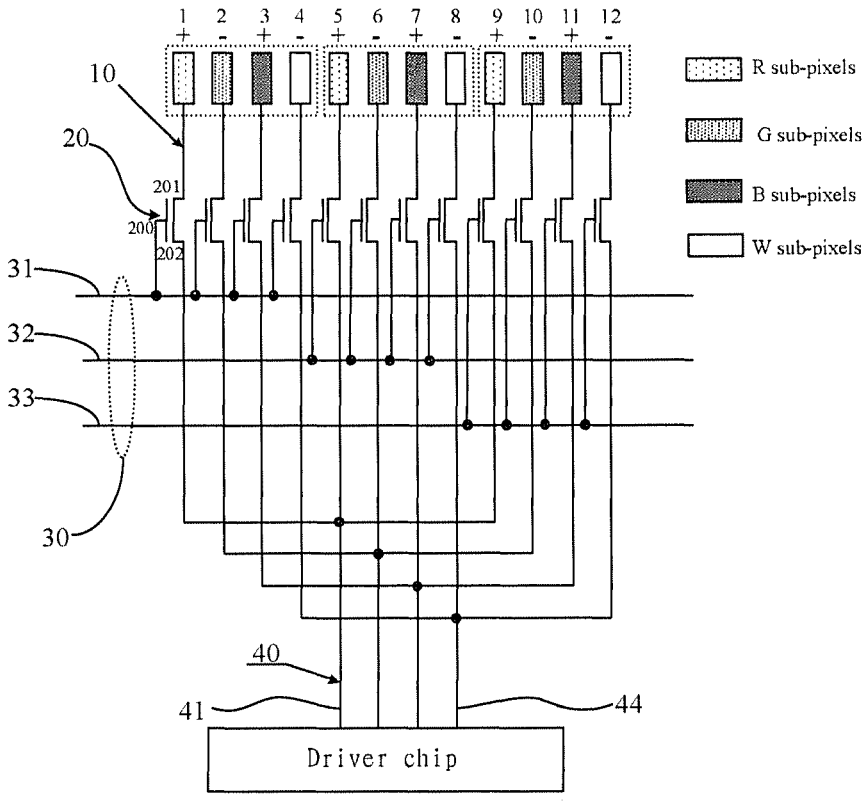
FIG. 8 is a schematic structure diagram of a source driving circuit according to an embodiment of the present disclosure.

FIG. 8 is a schematic structure diagram of a source driving circuit according to an embodiment of the present disclosure. Only one driving sub-circuit is illustrated in FIG. 8. The on/off timing diagrams of the sub-control lines in the embodiment of the present disclosure are illustrated in FIG. 2. Different from FIG. 7, in the present embodiment, the number p of the sub-control lines is 3, and the turn on duration of each of the sub-control lines is T/3.

In this embodiment, one driving sub-circuit correspondingly drives data lines corresponding to three sequentially adjacent pixel units. The driving sub-circuit includes four source channels, each of which is electrically connected to the second terminals of three switches, as illustrated in FIG. 8.

In each driving sub-circuit, the $j^{th}$ sub-control line is electrically connected to the control terminals of the switches corresponding to the $(4(j-1)+1)^{th}$, . . . , $(4(j-1)+4)^{th}$ data lines in each driving sub-circuit, respectively. In each driving sub-circuit, the $i^{th}$ source channel is electrically connected to the second terminals of the switches corresponding to the $i^{th}$, $(i+4)^{th}$, $(i+8)^{th}$ data lines, respectively, where j may be 1, 2, or 3, and i may be 1, 2, 3, or 4.

In the driving sub-circuit illustrated in FIG. 8, the number of source channels is 4. Among the four source channels, the first source channel 41 is electrically connected to the second terminals 202 of the switches corresponding to the $1^{st}$, $5^{th}$ and $9^{th}$ data lines; the second source channel 42 is electrically connected to the second terminals 202 of the switches corresponding to the $2^{nd}$, $6^{th}$ and $10^{th}$ data lines; the third source channel 43 is electrically connected to the second terminals 202 of the switches corresponding to the $3^{rd}$, $7^{th}$ and $11^{th}$ data lines; the fourth source channel 44 is electrically connected to the second terminals 202 of the switches corresponding to the $4^{th}$, $8^{th}$ and $12^{th}$ data lines. The number of sub-control lines is 3. Among the three sub-control lines, the first sub-control line 31 is electrically connected to the control terminals 200 of the switches corresponding to the $1^{st}$, . . . , $4^{th}$ data lines; the second sub-control line 32 is electrically connected to the control terminals 200 of the switches corresponding to the $5^{th}$, . . . , $8^{th}$ data lines; and the third sub-control line 33 is electrically connected to the control terminals 200 of the switches corresponding to the $9^{th}$, . . . , $12^{th}$ data lines.

The working principle of the driving circuit of the embodiment of the present disclosure will be described in detail below with reference to FIGS. 8 and 2.

Within one row scanning period T, when the first sub-control line 31 is turned on, the switches 20 corresponding to the $1^{st}$ to $4^{th}$ data lines in each driving sub-circuit are turned on, the first source channel, the second source channel, the third source channel, and the fourth source channel input data voltages to the corresponding $1^{st}$ to $4^{th}$ data lines, respectively, thus data is written to the $1^{st}$ to $4^{th}$ sub-pixels;

when the first sub-control line 31 changes from the high level to a low level and the second sub-control line 32 is turned on, the switches 20 corresponding to the $5^{th}$ to $8^{th}$ data lines in each driving sub-circuit are turned on, the first source channel, the second source channel, the third source channel, and the fourth source channel input data voltages to the $5^{th}$ to $8^{th}$ data lines, respectively, thus data is written to the $5^{th}$ to $8^{th}$ sub-pixels;

when the second sub-control line 32 changes from the high level to a low level and the second sub-control line 33 is turned on, the switches 20 corresponding to the $9^{th}$ to $12^{th}$ data lines in each driving sub-circuit are turned on, the first source channel, the second source channel, the third source channel, and the fourth source channel input data voltages to the $9^{th}$ to $12^{th}$ data lines, respectively, thus data is written to the $9^{th}$ to $12^{th}$ sub-pixels.

As such, corresponding data is written to the entire row of sub-pixels at the end of the row scanning period T.

Based on the disclosed concept of the foregoing embodiments, an embodiment of the present disclosure further proposes a display panel including the source driving circuit according to any of the foregoing embodiments. The display panel may be any product or component has a display function, such as a mobile phone, a tablet computer, a television, a display, a notebook computer, a digital photo frame, a navigator, and the like.

Figure 9:
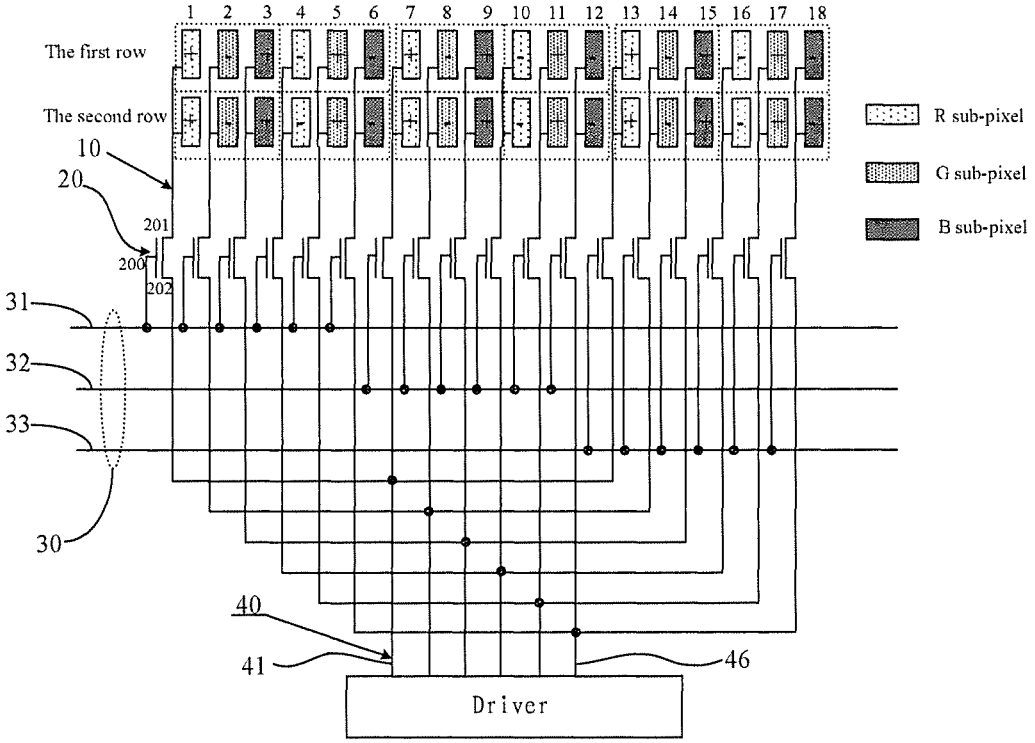
FIG. 9 is a schematic diagram of a display panel according to an embodiment of the present disclosure.

FIG. 9 is a schematic diagram of a display panel according to a fifth embodiment of the present disclosure. In this embodiment, a display area of the display panel includes M*N sub-pixels arranged in an array defined by M gate lines and N data lines, and here both M and N are positive integers greater than one. The N data lines are arranged in the direction of the row, and the N data lines are disposed in one-to-one correspondence with respect to the N columns of sub-pixels. The display panel adopts a column-based inversion mode, that is, the polarities of two adjacent columns of sub-pixels are opposite. For example, the polarities of odd-numbered columns of sub-pixels are positive (+), and those of even-numbered columns of sub-pixels are negative (−).

FIG. 9 illustrates a schematic diagram of the drive connection of 18 columns of sub-pixels located in only two rows. The pixel unit of the display panel includes three sub-pixels which are R sub-pixel, G sub-pixel, and B sub-pixel. One driving sub-circuit correspondingly derives data lines corresponding to 6 columns of pixel units. As can be seen from FIG. 9, the first terminals of the 18 switches 20 are connected to the 18 data lines corresponding to the 18 columns of sub-pixels, in one-to-one correspondence.

In the first row scanning period T, as the first sub-control line 31, the second sub-control line 32, and the third sub-control line 33 are sequentially turned on, data is sequentially written to the $1^{st}$ to $6^{th}$ column of sub-pixels, the $7^{th}$ to $12^{th}$ column of sub-pixels, and $13^{th}$ to $18^{th}$ column of sub-pixels in the first row; and In the second row scanning period T, as the first sub-control line 31, the second sub-control line 32, and the third sub-control line 33 are sequentially turned on, data is sequentially written to the $1^{st}$ to $6^{th}$ column of sub-pixels, the $7^{th}$ to $12^{th}$ column of sub-pixels, and $13^{th}$ to $18^{th}$ column of sub-pixels in the second row.

As such, corresponding data is written to both rows of sub-pixels at the end of the two row scanning periods.

In the description of the embodiments of the present disclosure, it should be noted that the term "connect/connection" shall be interpreted as an electrical connection unless otherwise explicitly stated and defined, and it may be a direct connection, or an indirect connection through an intermediate medium, or an internal communication between two components. The specific meanings of the above terms in the present disclosure can be understood according to the specific context by those skilled in the art.

The implementations of the present disclosure are disclosed above, however, it is to be noted that the description thereof is merely used to facilitate the understanding of the present disclosure, but not intended to limit the present disclosure. Any modification or variation in the form and details of the implementations may be made by those skilled in the art without departing from the spirit and scope of the disclosure. However, the scope of the present disclosure is defined by the appended claims.

We claim:

1. A source driving circuit comprising a plurality of driving sub-circuits, each of the plurality of driving sub-circuits comprises:

a driver, comprising a plurality of source channels, a plurality of switches, first terminals of the plurality of switches are electrically connected to a plurality of data lines of a display panel in one-to-one correspondence, wherein each of the plurality of source channels is electrically connected to second terminals of at least two of the plurality of switches, and a control line, electrically connected to control terminals of the plurality of switches, wherein sub-pixels corresponding to data lines, that are electrically connected to a same source channel through the switches, have the same polarity and the same color, wherein the source driving circuit is configured to drive a display panel composed of pixel units each comprising four sub-pixels, the four sub-pixels including a red sub-pixel, a green sub-pixel, a blue sub-pixel, and a white sub-pixel, wherein in one driving sub-circuit, a number of the switches is 12, and a number of the source channels is 4, wherein an $i^{th}$ source channel is electrically connected to second terminals of switches corresponding to $i^{th}$, $(i+4)^{th}$, and $(i+8)^{th}$ data lines, respectively, where i is 1, 2, 3, or 4, wherein the control line comprises three sub-control lines, wherein a $j^{th}$ sub-control line is electrically connected to control terminals of switches corresponding to $(4(j-1)+1)^{th}$, $(4(j-1)+2)^{th}$, . . . , $(4(j-1)+4)^{th}$ data lines, where j is 1, 2, or 3, wherein a turn on duration of each of the two sub-control lines is T/3, where T is a row scanning period, wherein within one row scanning period T, when the first sub-control line is turned on, the switches corresponding to the $1^{st}$ to $4^{th}$ data lines in each driving sub-circuit are turned on, the switches connected to the $1^{st}$ to $4^{th}$ data lines in each driving sub-circuit are turned on, the first source channel, the second source channel, the third source channel, and the fourth source channel input a red data voltage, a green data voltage, a blue data voltage, and a white data voltage to the corresponding $1^{st}$ to $4^{th}$ data lines, respectively, thus the red data voltage, the green data voltage, the blue data voltage, and the white data voltage are written to the red sub-pixel, the green sub-pixel, the blue sub-pixel, and the white sub-pixel of a first pixel unit;

when the first sub-control line changes from the high level to a low level and the second sub-control line is turned on, the switches connected to the $5^{th}$ to $8^{th}$ data lines in each driving sub-circuit are turned on, the first source channel, the second source channel, the third source channel, and the fourth source channel input a red data voltage, a green data voltage, a blue data voltage, and a white data voltage to the $5^{th}$ to $8^{th}$ data lines, respectively, thus the red data voltage, the green data voltage, the blue data voltage, and the white data voltage are written to the red sub-pixel, the green sub-pixel, the blue sub-pixel, and the white sub-pixel of a second pixel unit;

when the second sub-control line changes from the high level to a low level and the third sub-control line is turned on, the switches connected to the $9^{th}$ to $12^{th}$ data lines in each driving sub-circuit are turned on, the first source channel, the second source channel, the third source channel, and the fourth source channel input a red data voltage, a green data voltage, a blue data voltage, and a white data voltage to the $9^{th}$ to $12^{th}$ data lines, respectively, thus the red data voltage, the green data voltage, the blue data voltage, and the white data voltage are written to the red sub-pixel, the green sub-pixel, the blue sub-pixel, and the white sub-pixel of a third pixel unit.

2. The source driving circuit of claim 1, wherein the sub-pixels corresponding to the data lines, that are electrically connected to the same source channel through the switches, are sequentially adjacent sub-pixels of the same polarity and the same color.

3. A display panel comprising a source driving circuit of claim 1.

* * * * *